US007969824B2

(12) United States Patent
Wiederrecht et al.

(10) Patent No.: US 7,969,824 B2
(45) Date of Patent: Jun. 28, 2011

(54) TIMEPIECE MOVEMENT FOR DRIVING A DISPLAY ELEMENT ALONG A COMPLEX PATH AND TIMEPIECE COMPRISING SUCH A MOVEMENT

(75) Inventors: Jean-Marc Wiederrecht, Bernex (CH); Paul Junod, Bienne (CH)

(73) Assignee: Agenhor SA, Meyrin (CH)

( * ) Notice: Subject to any disclaimer, the term of this patent is extended or adjusted under 35 U.S.C. 154(b) by 401 days.

(21) Appl. No.: 12/375,746

(22) PCT Filed: Jul. 31, 2007

(86) PCT No.: PCT/IB2007/002280

§ 371 (c)(1),
(2), (4) Date: Jan. 30, 2009

(87) PCT Pub. No.: WO2008/015568

PCT Pub. Date: Feb. 7, 2008

(65) Prior Publication Data

US 2009/0185453 A1 Jul. 23, 2009

(30) Foreign Application Priority Data

Aug. 1, 2006 (EP) ..... 06015949

(51) Int. Cl.
*G04B 19/02* (2006.01)
*G04B 19/00* (2006.01)

(52) U.S. Cl. ..... 368/220; 368/223

(58) Field of Classification Search ..... 368/220–223, 368/228–229, 238

See application file for complete search history.

(56) References Cited

U.S. PATENT DOCUMENTS

| | | | | |
|---|---|---|---|---|
| 1,776,001 | A * | 9/1930 | Konigsberg | 368/235 |
| 1,871,204 | A * | 8/1932 | Vernon | 40/472 |
| 2,292,458 | A * | 8/1942 | Maser | 368/80 |
| 3,554,158 | A * | 1/1971 | Shimano et al. | 116/28.1 |
| 3,696,609 | A * | 10/1972 | Dubois | 368/220 |
| 3,823,544 | A * | 7/1974 | Torrence | 368/19 |

(Continued)

FOREIGN PATENT DOCUMENTS

CH 666591 8/1988

(Continued)

OTHER PUBLICATIONS

International Search Report dated Feb. 14, 2008, in PCT application.

*Primary Examiner* — Sean Kayes
(74) *Attorney, Agent, or Firm* — Young & Thompson

(57) ABSTRACT

A timepiece, includes a frame supporting a drive element, a time base and drive trains pivotably mounted on the frame and arranged so as to drive at least one display train intended to carry an element displaying information, such as the time. The movement also includes a fixed gear, firmly attached to the frame, with which a toothed element of the display train is arranged to mesh, and a drive element having first and second kinematic links, respectively, with one of the drive trains and with the toothed element so as to drive the latter in translation in a first direction along the fixed gear. Preferably, the drive element is embodied in the form of a deformable element, and the movement also includes a retrograde mechanism for driving the toothed element rapidly in the opposite direction by means of the drive element.

11 Claims, 6 Drawing Sheets

U.S. PATENT DOCUMENTS

| | | | | | |
|---|---|---|---|---|---|
| 3,852,949 | A | * | 12/1974 | Sayler | 368/76 |
| 4,022,015 | A | * | 5/1977 | Bailey | 368/40 |
| 4,024,767 | A | * | 5/1977 | Kampf | 73/866.1 |
| 4,326,430 | A | * | 4/1982 | Hamada | 74/10.52 |
| 4,455,094 | A | * | 6/1984 | Russell | 368/65 |
| 4,852,072 | A | * | 7/1989 | Sullivan | 368/238 |
| 5,103,434 | A | | 4/1992 | Sullivan | |
| 5,199,006 | A | * | 3/1993 | Ferrara | 368/76 |
| 5,303,211 | A | * | 4/1994 | Yanaka et al. | 368/76 |
| 7,515,508 | B1 | * | 4/2009 | Stotz | 368/80 |
| 2002/0145945 | A1 | * | 10/2002 | Bucci | 368/223 |
| 2007/0070819 | A1 | * | 3/2007 | Choksi et al. | 368/76 |
| 2008/0178792 | A1 | * | 7/2008 | Pala et al. | 116/288 |

FOREIGN PATENT DOCUMENTS

| | | |
|---|---|---|
| DE | 29520126 | 4/1996 |
| DE | 29903950 | 5/1999 |
| EP | 0509965 | 10/1992 |
| GB | 13540 | 0/1915 |
| WO | 2004006026 | 1/2004 |

* cited by examiner

TIMEPIECE MOVEMENT FOR DRIVING A DISPLAY ELEMENT ALONG A COMPLEX PATH AND TIMEPIECE COMPRISING SUCH A MOVEMENT

TECHNICAL FIELD

The present invention concerns a timepiece movement comprising a frame supporting a motor organ, a time base and drive trains, mounted pivoting on the frame, arranged so as to drive at least one display train designed to carry an information display element.

More particularly, the present invention concerns a movement of this type, and a timepiece integrating this movement, arranged so as to enable the driving of a display element along an original path, noticeably different from the conventional rotation around a fixed axis relative to the frame of the movement.

PRIOR ART

Many movements have been developed thanks to which an original driving of a display element can be realized. In particular, many timepiece manufacturers have marketed retrograde display movements whereof one interest resides in the particular kinematics of the associated display element.

As an example, patent application CH 666 591 A3, filed in the names of J.-M. Wiederrecht and R. Dubuis and published Aug. 15, 1988, describes a movement of this type, comprising a snail cam, having a substantially radial flank, and a ratchet comprising a finger cooperating with the edge of the cam as well as a toothed sector cooperating with a pinion mounted rotating on the frame of the movement. The pinion supports an indicator hand cooperating with an indicator in sector form and is subject to a return torque exerted by a balance spring. When the hand arrives at one end of the sector, the finger of the ratchet falls along the radial flank of the cam under the effect of the torque from the balance spring, returning the hand to the beginning of the sector.

Document U.S. Pat. No. 5,103,434 proposes a movement in which a fixed gear is engaged with a toothed element belonging to the display element being arranged engaged with the fixed toothing. Moreover, the movement comprises a drive element having first and second kinematic connections, respectively, with one of the drive trains and with the display train to drive the latter in translation, in a first direction, along the fixed toothing.

BRIEF DESCRIPTION OF THE INVENTION

The primary aim of the present invention is to propose an alternative to the existing movements, in particular by enabling an original driving of an indicator element.

To this end, the invention more particularly concerns a movement for a timepiece of the aforementioned type. When a display element is assembled to the display train, it has a rotational movement which is combined with a translational movement along the fixed gear, giving rise to a non-circular path of the display element.

According to the invention, the fixed toothing has first and second ends, distant from each other, the movement being arranged in order also to allow driving of the display train in the direction opposite the first direction. Advantageously, the movement comprises a retrograde-type mechanism in this case.

One can also provide at least one guide surface extending at a substantially constant distance from the fixed gear and against which the display train is designed to be arranged bearing at least indirectly.

The drive element is preferably realized in the form of a deformable loop, in particular by a belt or a chain.

For information, the movement according to the present invention may advantageously be implemented in a timepiece in order to enable the display of different magnitudes, in particular, the second, the minute, the hour, a second time zone, the day of the week, the date, the phases of the moon, a power-reserve, an equation of time or the sunrise and sunset times.

BRIEF DESCRIPTION OF THE DRAWINGS

Other characteristics and advantages of the present invention will appear more clearly upon reading the detailed description of preferred embodiments which follows, done in reference to the appended drawings provided as non-limiting examples and in which.

DETAILED DESCRIPTION OF THE INVENTION

The set of figures illustrates a movement in which the present invention is implemented in order to control a hand displaying the hour, as a non-limiting example.

Figure 1A:
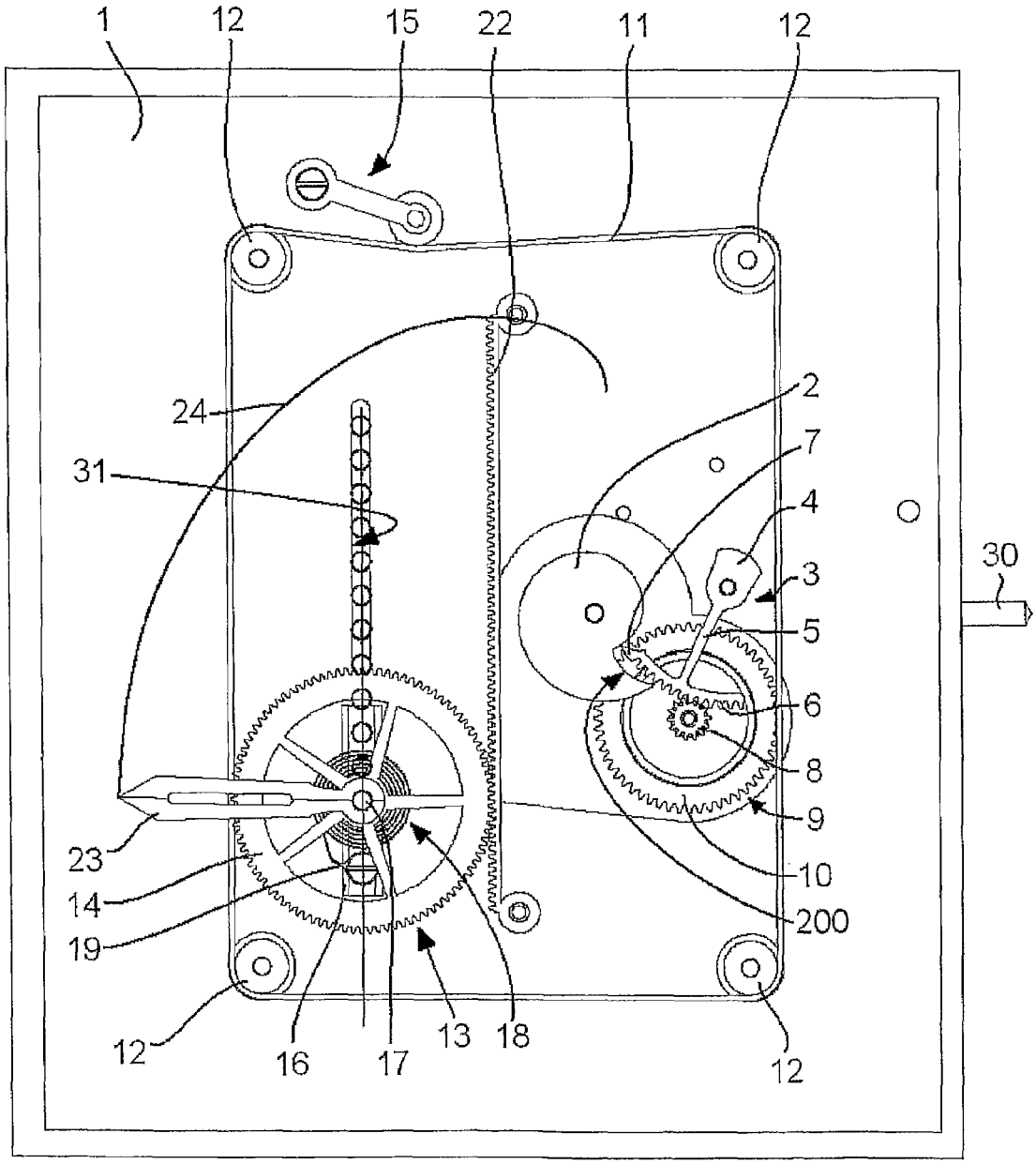
FIG. 1*a* illustrates a simplified top view of part of a timepiece movement according to a first embodiment of the present invention, in a first operating position.
Figure 1B:
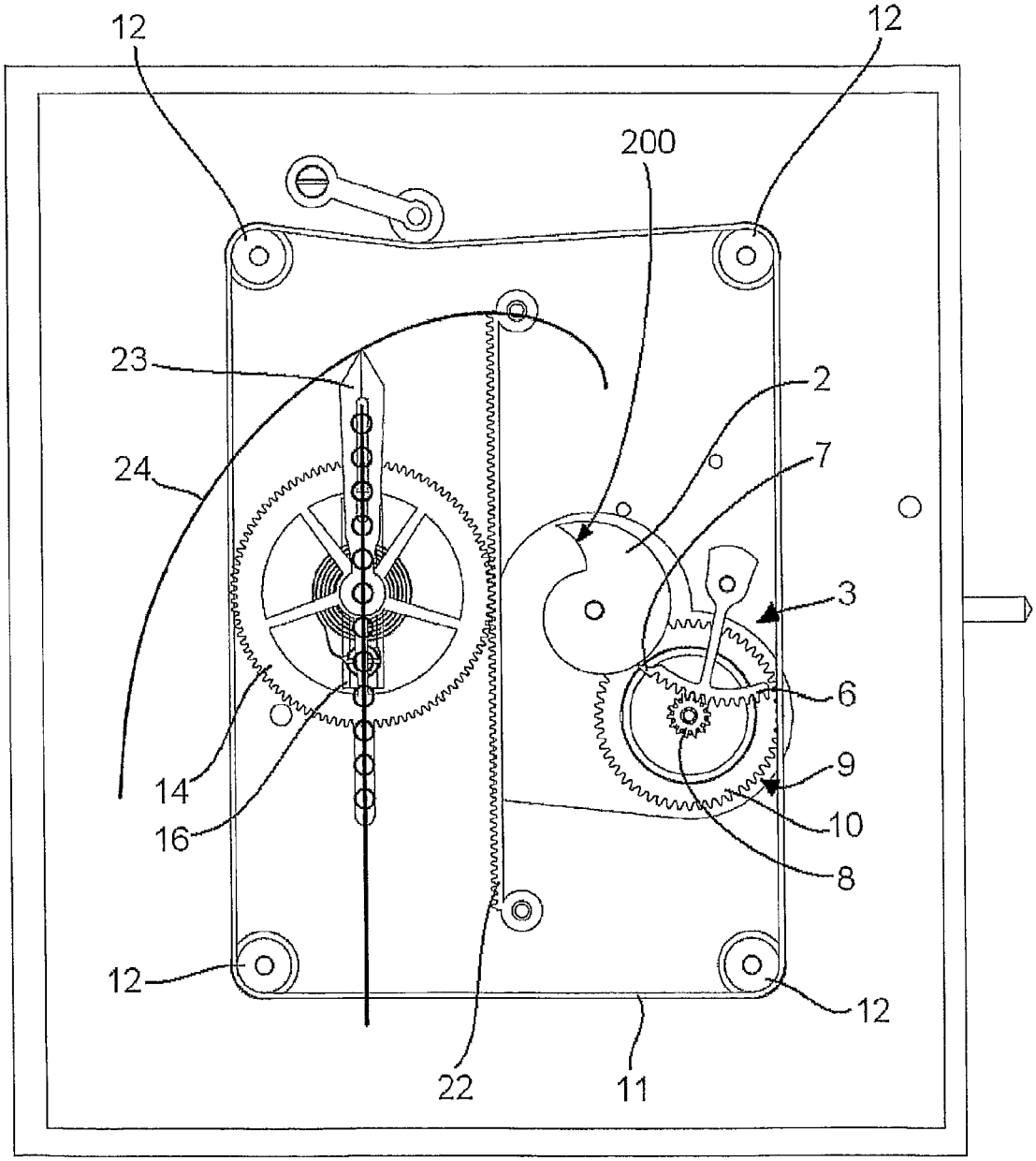
FIG. 1*b* illustrates a simplified top view of the movement of FIG. 1*a*, in a second operating position.
Figure 1C:
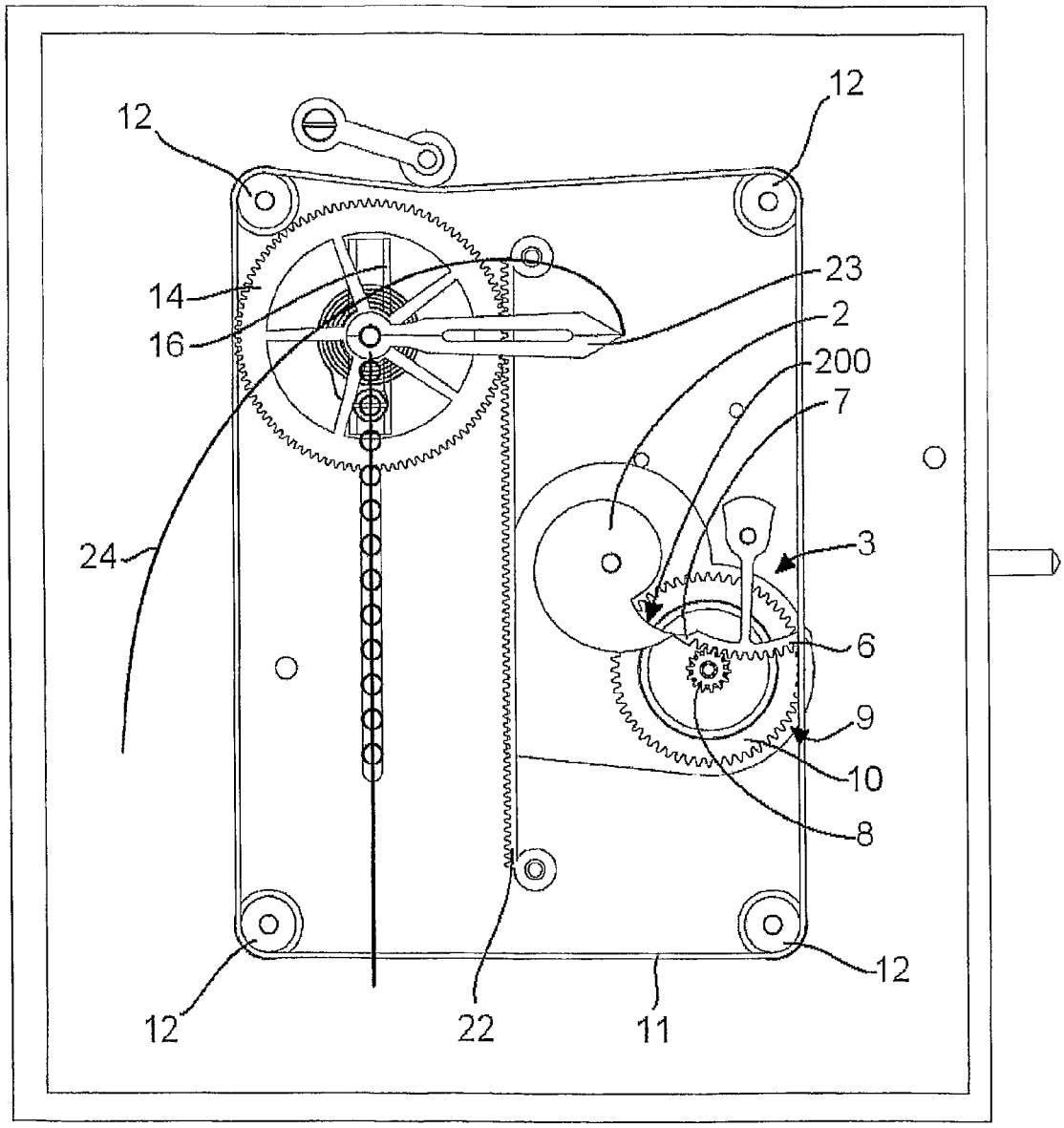
FIG. 1*c* illustrates a simplified top view of the movement of FIG. 1*a*, in a third operating position.

FIGS. 1*a*, 1*b* and 1*c* illustrate simplified top views of a part of a timepiece movement having the characteristics of the present invention according to a first preferred embodiment, in the first, second and third operating positions.

The movement illustrated in FIG. 1*a* comprises a frame 1 carrying a drive element, which is not visible in the figures, and which can be a barrel spring or a motor powered from an electrical energy source without any impact on the implementation of the present invention. The energy source transmits its energy to a time base in order to drive the oscillations of the latter. Likewise, the time base can be a sprung balance connected to an escapement or also a quartz, without modifying the nature of the present invention.

Trains are driven conventionally, from the going train, in order to control the movements of one or several display elements.

In the embodiments illustrated in the figures, a wheel, not visible, which can be the hour wheel, is driven from the going train and supports a snail cam 2, integral with the wheel of the hour wheel. Structures of this type are commonly used in retrograde-type movements. The cam, as illustrated in the figures, is thus driven in rotation in the clockwise direction.

A ratchet 3 is mounted pivoting on the frame by its base 4, from which an arm 5 extends carrying a toothing 6 in the shape of a circular arc. One end of the toothing is extended by a finger 7 arranged bearing against the edge of the snail cam 2, such that the variations in the radius of the periphery of the cam, related to its rotation, drive a pivoting of the ratchet in reference to the frame.

The toothing 6 of the ratchet is arranged engaged with a pinion 8 of a reducer train 9 mounted pivoting on the frame. The reducer train comprises a wheel 10, integral in rotation with the pinion 8, and arranged engaged with a drive member 11, elongated and deformable.

The drive element 11 can be realized in various manners adapted to the implementation of the present invention, in particular in the form of simple elastic, a belt, notched or not, or a chain. Here we have diagrammed the use of a belt. This belt is arranged on the frame 1 so as to be stretched between four pulleys 12 mounted rotatingly on the frame.

The belt 11 is arranged simultaneously engaged with a display train 13, more specifically with the toothing of a display wheel 14 of this train.

A tightening mechanism 15 is also provided to ensure maintenance of a minimum level of tension of the belt 11, this part having characteristics adapted in order to allow effective transmission of movements from the belt 11 to the display wheel 14. This tightening mechanism will not be described in detail here inasmuch as one skilled in the art will not encounter particular difficulties for its implementation.

The display train 13 also comprises a carriage 16, mounted free in translation on the frame of the movement, and supporting in particular an arbor 17 free to turn in reference to the carriage and on which the display wheel 14 is mounted integrally. A balance spring 18 is fixed to the carriage by a first end 19 and to the arbor 17 by its second end (not visible). The balance spring exerts a force on the arbor 17 tending to maintain the display wheel 14 in the position illustrated in FIG. 1*a*.

Moreover, the movement according to the present invention also comprises a rail 22 having a toothing and mounted fixed on the frame 1. The display wheel 14 is arranged so as to mesh constantly with the toothing of the rail 22.

We have also illustrated, in the figures, an hour hand 23 driven on the arbor 17 of the display train and designed to indicate the hours across from indications 24, illustrated diagrammatically in the figures, and carried by a dial (not visible).

The operation of the mechanism which was just described will now be explained, in relation with FIGS. 1*a*, 1*b* and 1*c*.

Let us consider, as a non-limiting example, that the hour hand 23 indicates noon or midnight in its position illustrated in FIG. 1*a*, the indications 24 extending over twelve hours.

FIG. 1*b* illustrates the configuration of the movement six hours after that of FIG. 1*a*. The snail cam 2 performs a half-revolution during these six hours, according to the embodiment illustrated and described, which causes a rotation of the ratchet 3 in the counterclockwise direction.

The pivoting of the ratchet causes the rotation of the reducer train 9 in the clockwise direction, driving a translational movement of the belt 11, toward the bottom of the figures in the region of the reducer train 9. As a result, the belt portion 11 located engaged with the display wheel 14 moves simultaneously in translation, toward the top of the figures, driving a rotation of the display train in the clockwise direction.

The rotation of the display wheel causes it to turn without sliding on the toothing of the fixed rail 22, as a direct result of the meshing provided between these two elements, this movement being made possible by the ability of the carriage to move in translation relative to the frame. Thus, the arbor 17 of the display train has combined translational and rotational movements which cause the free end of the hand 23 to follow a path corresponding to the curve diagramming the hour indications 24.

During the six hours separating the configuration of FIG. 1*a* from that of FIG. 1*b*, the display wheel performs a quarter revolution, whereas it performs an additional quarter revolution in order to arrive at the configuration of FIG. 1*c*, reached six hours after that of FIG. 1*b*.

Moreover, in the twelve hours separating the respective configurations of FIGS. 1*a* and 1*c*, the cam 2 performs a complete revolution such that, in the configuration of FIG. 1*c*, the finger 7 of the ratchet is found near the radial flank 200 of the edge of the cam.

The pivoting of the ratchet 3 during these twelve hours opposes the force exerted by the balance spring 18 on the arbor 17 of the display train. Thus, when the finger 7 of the ratchet crosses the radial flank of the cam 2, due to the continuous rotation of the latter part, the kinematic chain connecting the ratchet to the display train 14, comprising the reducer mobile 9 and the belt 11, is likely to undergo the force exerted by the balance spring on the arbor 17 in order to produce a rapid retrograde movement of the display train 13, this kinematic chain and the ratchet 3.

Like what was described above, the torque undergone by the display train causes the combined rotational and translational movements of the latter due to its meshing with the toothing of the fixed rail 22. The display train is then driven rapidly on the toothing of the fixed rail, driving the carriage 16 in translation in reference to the frame, such that it resumes its initial position, namely that illustrated in FIG. 1*a*.

At the same time, the hour hand 23, integral in rotation with the arbor 17, describes a path opposite that traveled during the twelve preceding hours. A new twelve-hour cycle then starts over at this moment, as just described.

One will note that the location of the balance spring as illustrated and described is preferred, but not limiting, as it makes it possible to avoid the appearance of play in the kinematic connection between the ratchet 3 and the display train 14, without having to resort to gears of a particular type which constitute an effective, but costly alternative.

Moreover, a setting stem 30, which can also serve as winding mechanism, has been diagrammed in the figures. One skilled in the art will not encounter any particular difficulties for its implementation, depending on his own needs.

We have also diagrammed the presence of a dial, which may be transparent for esthetic reasons, arranged above the movement, when this is mounted in a timepiece case, this dial comprising a rectilinear slot 31 defining lateral support or guide surfaces for the display train 13 during its translational movement in reference to the frame. One can, for example, provide that the carriage 16 has a wheel coaxial to the arbor 17 and the edge of which is arranged in permanent contact with the edges of the slot 31.

Figure 2A:
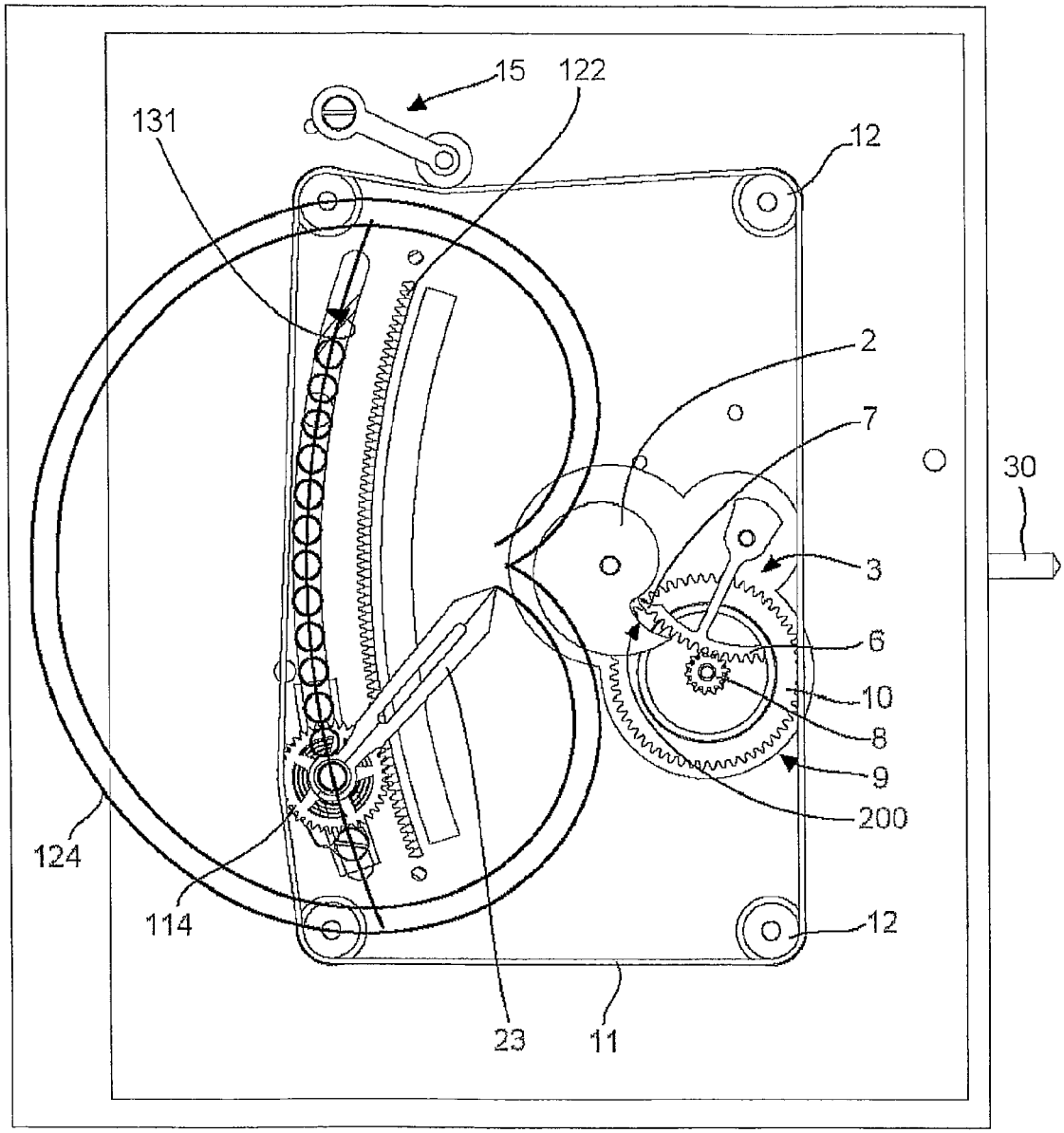
FIG. 2*a* illustrates a simplified top view of part of a timepiece movement according to a second embodiment of the present invention, in a first operating position.
Figure 2B:
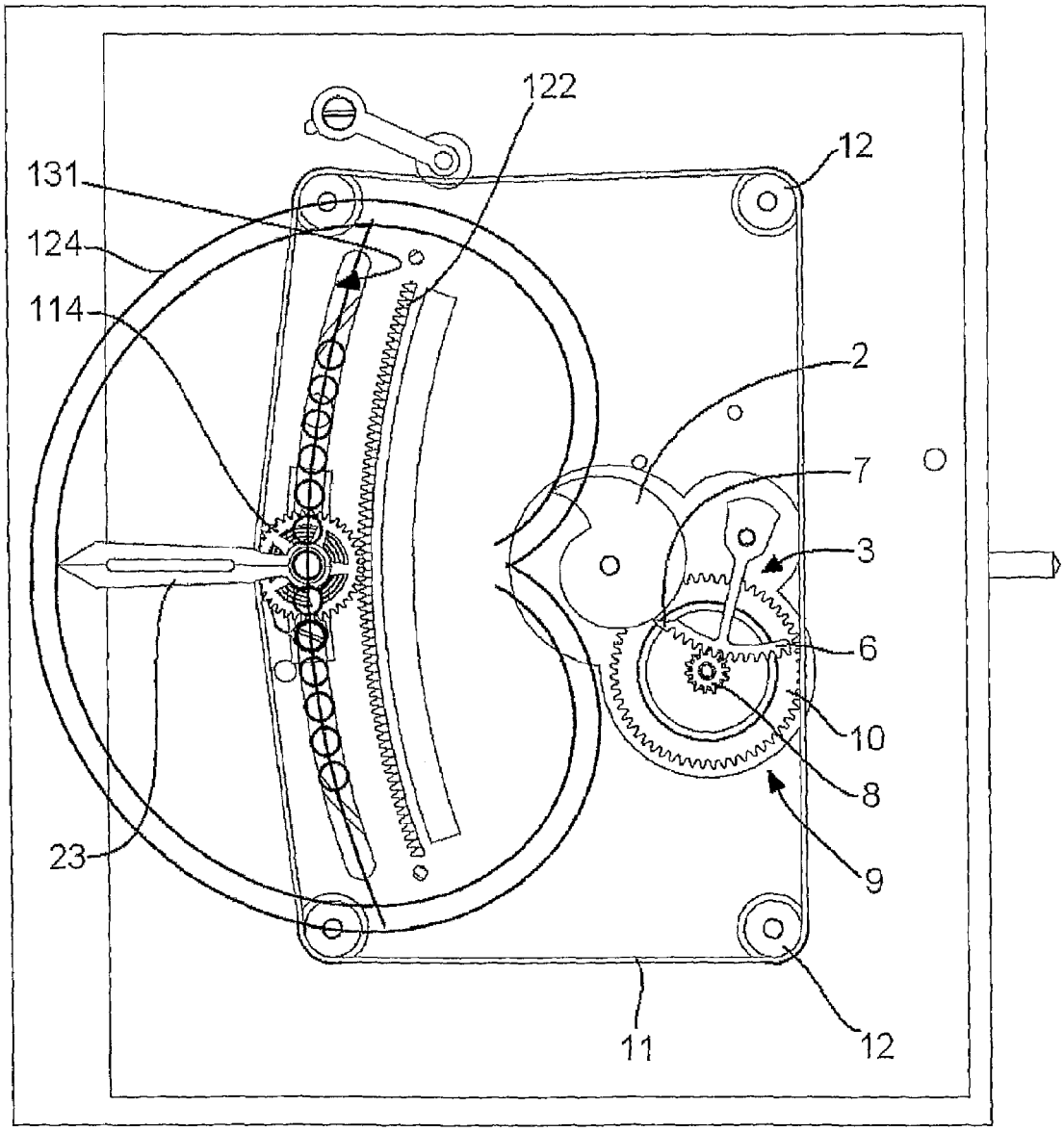
FIG. 2*b* illustrates a simplified top view of the movement of FIG. 2*a*, in a second operating position.
Figure 2C:
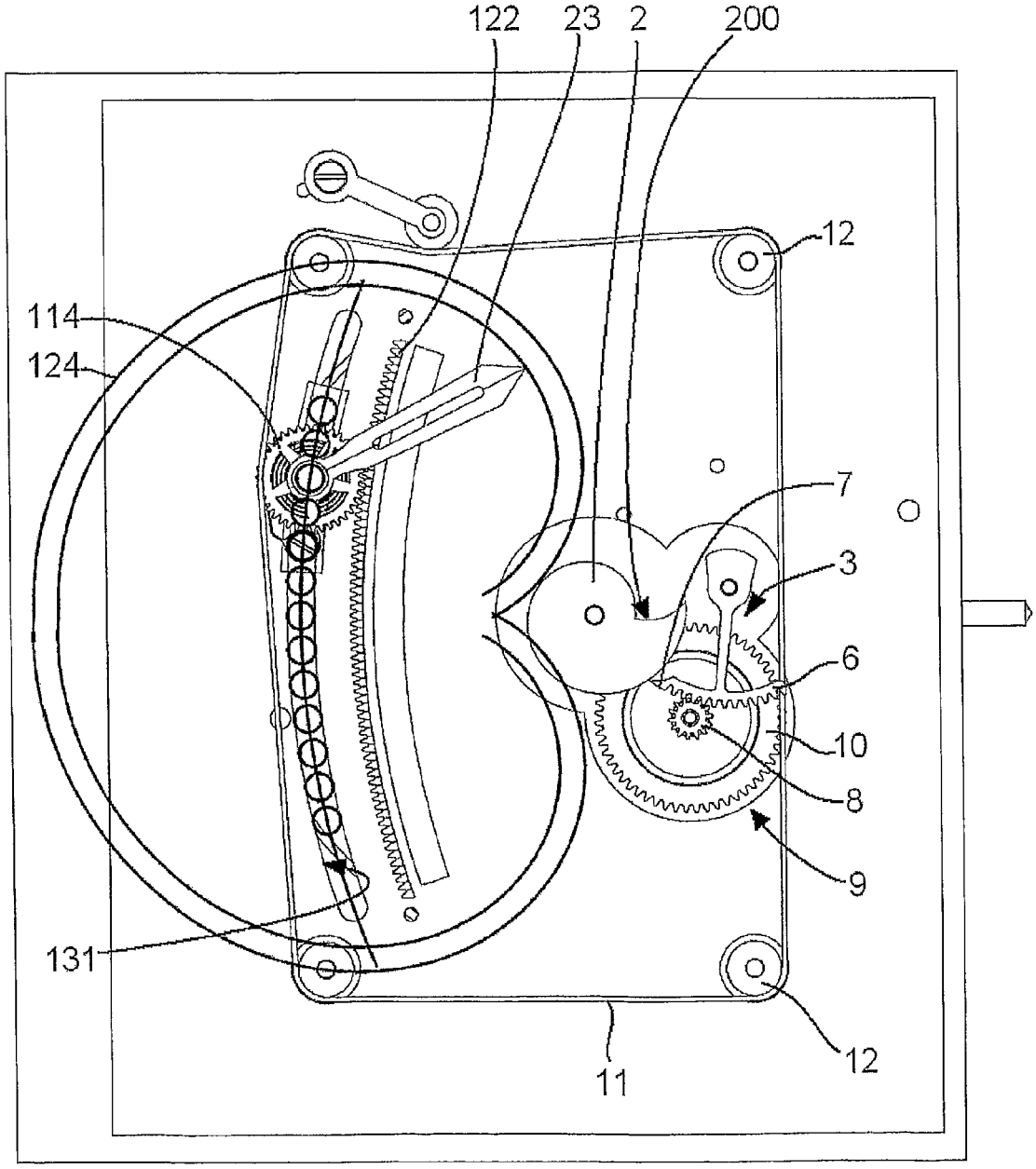
FIG. 2*c* illustrates a simplified top view of the movement of FIG. 2*a*, in a third operating position.

FIGS. 2*a*, 2*b* and 2*c* illustrate a second preferred embodiment of the movement according to the present invention, in particular the fact that the latter is of course not limited to the form of the fixed rail carrying the toothing with which the display train meshes, nor to the reduction factor implemented between the toothing of the ratchet and the display train. Moreover, the second embodiment illustrates the fact that the path of the display element depends primarily on the shape of the fixed gear as well as on this reduction factor, considered in relation to the length of the travel of the display wheel on the fixed gear.

The elements already described in relation to the first embodiment bear the same numerical references for simplification, and will not be discussed again in detail.

Two primary changes were made when going from the first embodiment to the second, namely the sizing of the display wheel, the wheel 114 having smaller dimensions than the display wheel 14, and the form of the fixed rail 122 carrying the toothing on which the display wheel rolls. We have diagrammed the fixed rail as being reduced to a toothing to simplify the figures, non-limitingly.

The fact that the display wheel 114 has a small diameter noticeably increases the angle traveled by the hour hand 23, the curvature of the fixed rail influencing the shape of the path followed by the display wheel 114 when it rolls on the fixed toothing, and therefore the path followed by the free end of the hand 23. As in FIGS. 1*a*, 1*b* and 1*c*, hour indications 124 have been diagrammed, by a double line, in FIGS. 2*a*, 2*b* and 2*c*, these being substantially heart-shaped.

Moreover, we have also diagrammed the presence of a dial, possibly transparent for esthetic reasons, in which a slot 131, curved, is arranged, defining guide surfaces for the carriage 16. The slot 131 preferably extends at a constant distance from the rail 122 in order to ensure maintenance of the meshing between the display wheel 114 and the toothing of the fixed rail 122 during translational movements of the carriage 16.

FIGS. 2*b* and 2*c* illustrate the respective configurations of the movement of FIG. 2*a* six hours later and ten hours later. The operation of the mechanism being identical to what was described above, it will not be described in further detail.

In particular, when the cam 2 completes a full revolution, the finger 7 of the ratchet 3 crosses the radial flank 200 of the cam, which causes a rapid return of the elements of the kinematic chain between the ratchet and the display wheel, until their respective initial positions, namely those visible in FIG. 2*a*. Like in the first embodiment, the retrograde movement is caused by the force exerted by the balance spring 18 on the arbor 17 of the display train 113.

The preceding description corresponds to preferred embodiments of the invention described non-limitingly. In particular, the embodiments illustrated and described for the different component elements of the timepiece movement are not limiting.

As previously mentioned, the movement according to the present invention can be implemented to realize the display of different magnitudes in alternative to the display of the hour, including a second time zone, the minute, the second, the day of the week, the date, the phases of the moon, or other magnitudes such as the power-reserve, the equation of time, the sunrise or sunset time. One skilled in the art will not encounter particular difficulties in adapting the known mechanisms of the prior art allowing the display of these magnitudes during implementation of the present invention. Of course, in the case of display of the power-reserve, for example, the movement would comprise a bi-directional drive mechanism of the belt, or other drive element of this type, in order to take into account the charge and discharge of a barrel spring, replacing the retrograde mechanism which was just described.

One can note that in the case where the present invention is implemented in a timepiece of the electromechanical type, the gear trains can be any, and one skilled in the art will not encounter any particular difficulties in adapting them to his own needs.

Likewise, it is possible to provide a jumping display of the desired magnitude. As an example, from the embodiments described, one can consider mounting a twelve-star integral in rotation with the cam 2 in order to obtain movements of the cam by successive jumps.

Moreover, one can provide a correction of the value of the magnitude displayed by increments of one unit. Thus, in the case of the hour, one could provide a corrector which, upon each pressure, would make it possible to turn the cam 2 by one twelfth of a revolution.

As previously mentioned, the drive element 11 can be realized in various forms without going beyond the scope of the present invention, in particular in the form of a belt, notched or not, simple elastic, or a chain. Likewise, one skilled in the art will not encounter any particular difficulties to modify the number and locations of the pulleys, or other adapted guide means, as described in relation with the two embodiments which have just been described. The same comment is applicable to the tightening organ illustrated.

One may also provide for the simultaneous use of two mechanisms of the type just described in a same movement, or more, for example so as to display the hour and the minute following two novel paths.

The invention claimed is:

1. A timepiece movement comprising:

a frame;

a time base;

a toothed rack fixed relative to said frame;

a circular gear mobile relative to said frame;

a drive element, formed as either a belt or a chain, held in tension relative to said circular gear and frame;

said circular gear being held in place between the drive element and the rack so that teeth of the circular gear engage teeth of the rack, such that said circular gear is driven in rotation by the drive element along a length of the toothed rack; and a hand rotationally fixed to the circular gear such that the movement of the circular gear along the rack provides an indication of time information measured by the time base.

2. The movement of claim 1, comprising a retrograde mechanism designed to enable driving of said circular gear at a first speed in said first direction from an initial position to a final position and driving of said circular gear at a second, faster speed in said opposite direction from said final position to said initial position.

3. The movement of claim 2, wherein said retrograde mechanism comprises a balance spring mounted coaxially to said circular gear and arranged so as to act on the same in order to roll said circular gear on said toothed rack, in said opposite direction, from said final position to said initial position.

4. The movement of claim 1, comprising at least one guide surface extending at a substantially constant distance from said toothed rack and against which said circular gear is designed to be arranged bearing at least indirectly.

5. The movement of claim 2, comprising at least one guide surface extending at a substantially constant distance from said toothed rack and against which said circular gear is designed to be arranged bearing at least indirectly.

6. The movement of claim 3, comprising at least one guide surface extending at a substantially constant distance from said toothed rack and against which said circular gear is designed to be arranged bearing at least indirectly.

7. The movement according to claim 1, wherein said drive element is deformable.

8. The movement of claim 1, comprising at least one tightening element acting on said drive element to provide tension in all of the positions of said circular gear.

9. The movement of claim 7, comprising at least one tightening element acting on said drive element to provide tension in all positions of said circular gear.

10. A timepiece comprising a case closed by a glass and containing a movement according to claim 1, the hand, visible through said glass, being carried by said circular gear in order to display the indication of time information selected from the group including seconds, minutes, hours, a second time zone, a day of the week, a date, a phase of the Moon, a power-reserve, an equation of time, a sunrise or sunset time.

11. A timepiece comprising a case closed by a glass and containing a movement according to claim 2, the hand, visible through said glass, being carried by said circular gear in order to display the indication of time information selected from the group including seconds, minutes, hours, a second time zone, a day of the week, a date, a phase of the Moon, a power-reserve, an equation of time, a sunrise or sunset time.

* * * * *